United States Patent [19]

Hashimoto

[11] 4,373,714

[45] Feb. 15, 1983

[54] TRANSFER DEVICE

[75] Inventor: Shinichi Hashimoto, Fujisawa, Japan

[73] Assignee: Tokyo Shibaura Denki Kabushiki Kaisha, Kawasaki, Japan

[21] Appl. No.: 240,284

[22] Filed: Mar. 4, 1981

[30] Foreign Application Priority Data

Mar. 5, 1980 [JP] Japan ..... 55-27645
Mar. 5, 1980 [JP] Japan ..... 55-27646

[51] Int. Cl.[3] ..... B65H 29/56
[52] U.S. Cl. ..... 271/310; 271/311
[58] Field of Search ..... 271/310, 311, DIG. 2; 118/245

[56] References Cited

U.S. PATENT DOCUMENTS 4,026,541 5/1977 Brooke ..... 271/311
4,223,993 4/1980 Tsuda ..... 271/311 X

FOREIGN PATENT DOCUMENTS 2557890 7/1976 Fed. Rep. of Germany ..... 271/311

*Primary Examiner*—Richard A. Schacher
*Attorney, Agent, or Firm*—Cushman, Darby & Cushman

[57] ABSTRACT

An electrostatic copying apparatus has a rotatable photosensitive drum including a first peripheral layer on which a visible image is formed and a second peripheral layer which is adjacent to the first peripheral layer along a shaft of the drum and on which a toner image is not formed, and a peeling mechanism for peeling a copying paper from the photosensitive drum, a transfer device including a transfer roller which is rotatably disposed in opposition to the photosensitive drum and cooperates with the photosensitive drum to nip a copying paper therebetween, and a DC power source for applying a surface electrical potential to the transfer roller to electrically attract the visible image from the photosensitive drum to the copying paper. In the copying apparatus, the transfer roller includes a first roller portion in opposition to the first peripheral layer of the photosensitive drum and a second roller portion coaxial with the first roller portion. The peeling mechanism is disposed in opposition to the second roller portion of the transfer roller which cooperates with the second roller portion to nip one end of the copying paper to peel the copying paper from the photosensitive drum.

14 Claims, 7 Drawing Figures

TRANSFER DEVICE

BACKGROUND OF THE INVENTION

The present invention relates to a transfer device for an electrostatic copying apparatus and, more particularly, to a transfer device with a transfer roller having a function to nip a copying paper between the transfer roller and a photosensitive drum.

In an electrostatic copying apparatus, a transfer process to transfer a toner image formed on a photosensitive layer laid on the surface of the photosensitive drum generally is executed by a transfer device. A process to peeling a copying paper transferred from the photosensitive drum is performed by a peeling device.

In recent years, there has been eager demands for sizedown and light-weight of the electrostatc copying apparatus. To satisfy such demands, there is a proposal to reduce a diameter of the photosensitive drum by improving a sensitivity of the photosensitive layer.

However, the image transfer and peeling processes, respectively, are still made by using the conventional transfer and peeling devices which require relatively large spaces around the photosensitive drum. Therefore, even if the diameter reduction of the drum is attained, there is a limit in realizing the sizedown and light-weight of the copying apparatus.

SUMMARY OF THE INVENTION

Accordingly, an object of the present invention is to provide a transfer device for an electrostatic copying apparatus without an additional peeling device which is small in size and light in weight without any disturbing the diameter reduction of the photosensitive drum.

According to the present invention, there is provided a transfer device for an electrostatic copying apparatus having a rotatable photosensitive drum including a first peripheral layer on which a visible image is formed and a second peripheral layer which is adjacent to the first peripheral layer along a rotating axis of the drum and on which a toner image is not formed, a peeling mechanism for peeling a copying paper from the photosensitive drum, a transfer roller which is rotatably disposed in opposition to the photosensitive drum and cooperates with the photosensitive drum to nip a copying paper therebetween, and means for applying a surface electrical potential to the transfer roller to electrically attract the visible image from the photosensitive drum and apply it to the copying paper, the improvement in which the transfer roller includes a first roller portion in opposition to the first peripheral layer of the photosensitive drum and a second roller portion coaxial with the first roller portion and the peeling mechanism is disposed in opposition to the second roller portion of the transfer roller which cooperates with the second roller portion to nip one end of the copying paper to peel the copying paper from the photosensitive drum.

The present invention will be better understood when carefully reading the following description in connection with the accompanying drawings, in which:

DETAILED DESCRIPTION OF THE PREFERRED EMBODIMENTS

A first embodiment of a transfer device for an electrostatic copying apparatus according to the invention will be described in detail referring to FIGS. 1 to 5.

Figure 1:
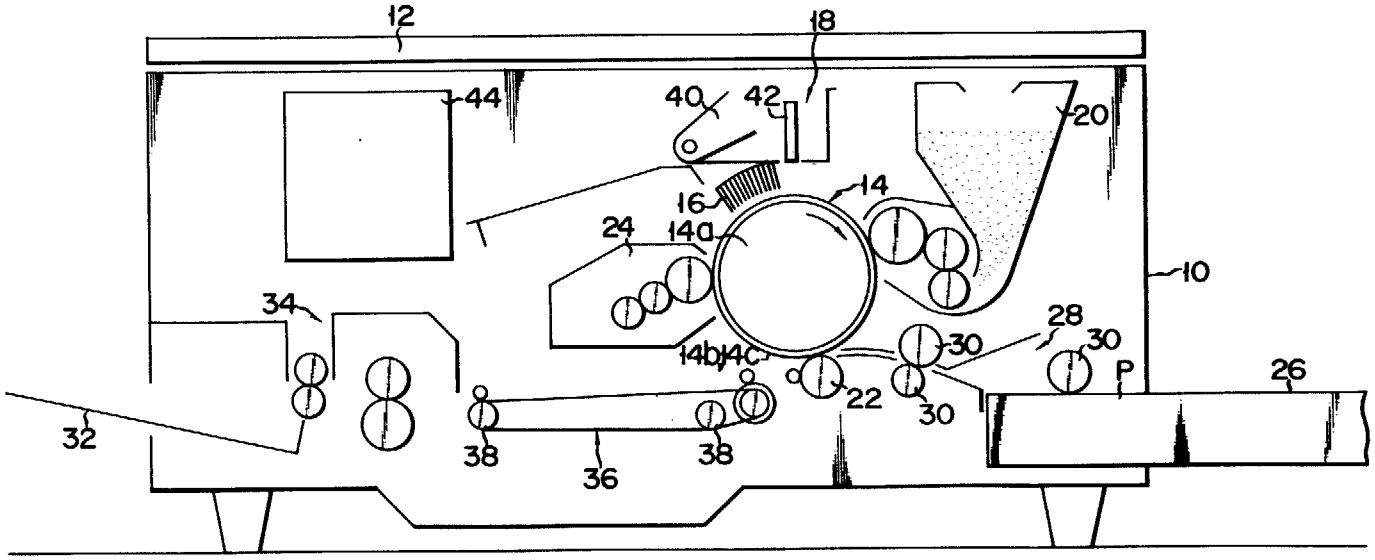
FIG. 1 is a schematic diagram of an electrostatic copying apparatus using a transfer device which is a first embodiment according to the present invention.
Figure 2:
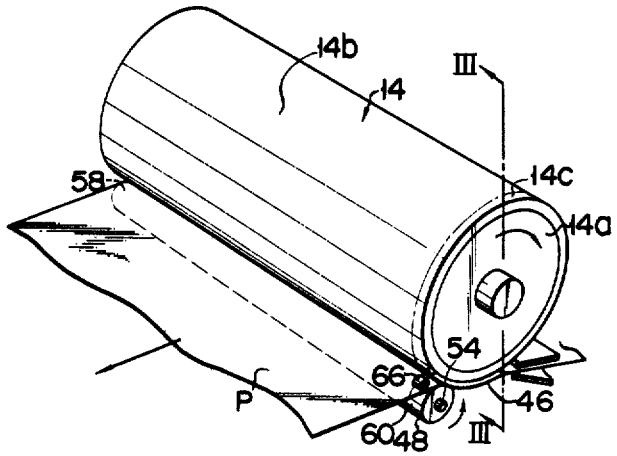
FIG. 2 is a perspective view of the transfer device of the invention used in the electrostatic copying apparatus shown in FIG. 1.
Figure 3:
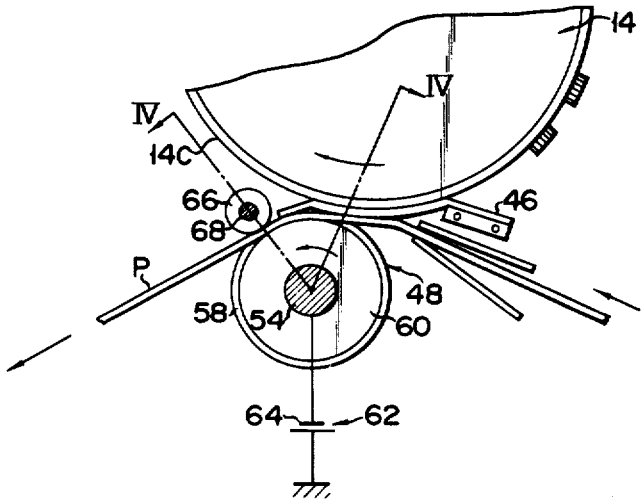
FIG. 3 is a side view of the transfer device as viewed in the direction of an arrow of line III—III in FIG. 2.
Figure 4:
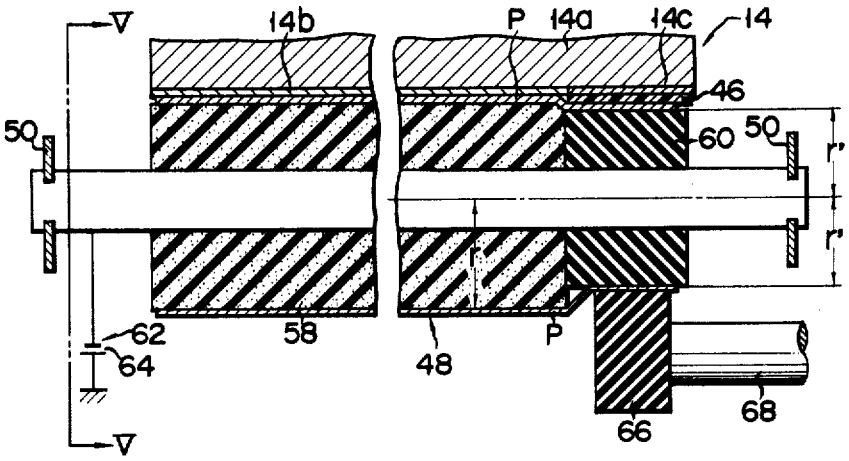
FIG. 4 is a longitudinal sectional view taken on line IV—IV in FIG. 3.

As shown in FIG. 1, an original rest 12 on which a document to be copied is put is reciprocately movably mounted on the upper surface of a main body 10 of an electrostatic copying apparatus. A photosensitive drum 14 is rotatably supported near the center of the space in the main body 10. The photosensitive drum 14 is comprised of a drum body 14*a*, a photosensitive layer 14*b* laid on the periphery surface of the drum body 14*a* except a ring-like part of one end portion of the drum periphery surface, and a non-visible image layer 14*c* formed on the ring-like part of the drum periphery surface. The photosensitive layer 14*b* is formed by coating the drum body 14*a* with material such as zinc oxide. The photosensitive drum 14 is driven by a drive motor 44 to be given later clockwise as viewed in the drawing. Disposed around the photosensitive drum 14 are a charger 16 for charging process, an exposing device 18 for exposing process, a developer 18 for developing process, a transfer device 22 for transfer and paper peeling process to be given later in detail, and a cleaner 24 for cleaning process in this order in the direction of rotation of the photosensitive drum 14. Those peripheral devices except the exposing device are in contact with the photosensitive layer 14*b* of the drum 14 under a given pressure. That is to say, the copying apparatus of this embodiment is of the contact type.

A paper supply cassette 26 for holding a pile of copying papers P is provided on a side wall of one end of the main body 10 of the copying apparatus. Further disposed within the main body 10 is a first transfer conveyor 28 for transferring the copying paper P taken out from the cassette 26 to the transfer device 22. The first transfer conveyor 28 is provided with a plurality of paper supply rollers 30. A tray 32 for receiving the copying paper P image-transferred is provided in a side wall of the other end of the main body 10. A fixing device 34 is also disposed continuous to the tray 32 within the main body 10. A second transfer conveyor 36 disposed between the fixing device 34 and the transfer device 22, is provided with a plurality of paper discharge rollers 38. The second transfer conveyor 36 transfers the copying paper P image-transferred in the transfer device 22 to the fixing device 34.

The exposing device 18 includes a lamp for illuminating the original rest 12 and an optical fiber 42 for leading rays of light reflected from an original disposed on the original rest 12 to the photosensitive layer 14*b* between the charger 16 and the developing device 20 to form an image on the original such as letters and graphs on the photosensitive layer 14b. The drive motor 44, which drives the photosensitive drum 14, also drives reciprocately the rest 12 in synchronism with the rotation of the photosensitive drum 14.

The transfer device 22 used in the electrostatic copying apparatus with such a construction will be described in detail referring particularly to FIGS. 2 to 5.

Figure 5:
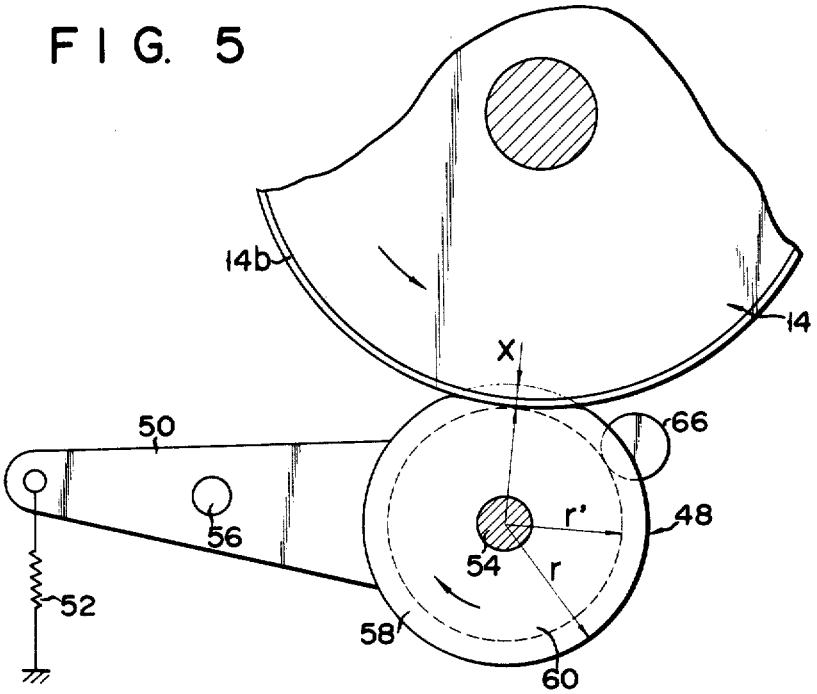
FIG. 5 is another side view of the transfer device as viewed in the direction of an arrow of line V—V in FIG. 4.

On the bottom of the non-visible image layer 14c on the drum 14, a peeling member 46 is fixed to the main body 10 of the copying apparatus so as to be allowed to contact the layer 14c. The peeling member 46 is a tape-shaped synthetic resin with a smoothed surface. Under the photosensitive drum 14, a transfer roller 48 extends in the direction of the axis of the drum 14 and rotatably contacts the bottoms of the photosensitive layer 14b and the non-visible image layer 14c. The transfer roller 48 with a rotatary shaft 54 is rotatably supported at both the ends of the shaft 54 by ends of a pair of support arms 50, as well illustrated in FIGS. 4 and 5. Each of support arms 50 is rotatably supported at the middle portion by a shaft 56 fixed to the main body 10, as shown in FIG. 5. A spring 52 coupled with the other end of each support arm 50 swings the support arm 50 counterclockwise in FIG. 5 to press the transfer roller 48 against the photosensitive drum 14.

The transfer roller 48 has a first roller portion 58 with a given radius r which is coaxial with a rotatable shaft 54 and has a length equal to the width of the photosensitive layer 14b, and a second roller portion 60 which is disposed adjacent the first roller portion 58 and coaxial with the shaft 54. The second roller portion 60 has a radius r' a given length x smaller than the radius r of the first roller portion 58 and a length equal to a width of the non-visible image layer 14c. The first roller portion 58 is made of soft and electrically conductive material. With the assistance of the photosensitive layer 14b, the first roller portion 58 nips the copying paper therebetween. The second roller portion 50 is made of electrically insulating and hard material. The second roller portion 60 also cooperates with the peeling member 46 to nip the copying paper P therebetween. The "soft material" means the material which is soft enough to allow the first roller portion 58 to be deformed with an amount x of distortion by the energization of the spring 52 when the first roller portion 58 is pressed against the photosensitive drum 14 by means of the spring 52. The "hard material" means the material with such a hardness that the second roller portion 60 is not deformed by the energization of the spring when the spring 52 presses the second roller portion 60 against the photosensitive drum 14.

The transfer roller 48 thus constructed is connected to a surface electrical potential applying means 62 with a DC power source 64. The minus terminal of the DC power source 64 is electrically connected to rotatable shaft 54 of the transfer roller 48, while the plus terminal is connected to ground. The drum body 14a of the photosensitive drum 14 is also connected to ground, although not shown. The DC power source 64 has a potential of about 500 V to 600 V and DC biases at the potential the peripheral surface of the first roller portion 58 through the shaft 54 of the transfer roller 48 to ground. The resistivity of the first roller portion 58 is preferably $10^3$ to $10^{10}$ ohm.cm. The first roller portion 58 is charged to a given surface potential by the DC bias means 64.

A small roller 66 as a peeling means rotatably contacts a given location on the peripheral surface of the transfer roller 48 which is in opposition to the non-visible image layer 14c of the photosensitive drum 14. The small or peeling roller 66 is rotatably supported by the main body 10 of the copying apparatus by way of a rotatable shaft 68. The peeling roller 66 for peeling the copying paper P transferred from the surface of the photosensitive drum 14 is disposed adjacent the end of the peeling member 46 downstream from the peeling member 46 as viewed in the transfer direction of the copying paper P.

The operation of the electrostatic copying apparatus with the construction as mentioned above will be discussed.

An original (not shown) is first put on the original rest 12. An operating section (not shown) is operated in accordance with a desired copy. Then, a copy start button (not shown) is pushed.

In response to the pushing of the start button, the charger 16 charges the photosensitive layer 14b of the photosensitive drum 14 and the lamp 40 illuminates the original. The drive motor 44 drives to rotate the drum 14, while at the same time reciprocates the rest 12 in synchronism with the rotation of the drum 14. Accordingly, the exposing device 18 forms an electrostatic latent image corresponding to the image on the original on the photosensitive layer 14b. The latent image is developed by the developing device 20 to be a visible toner image. The copying paper P is taken out sheet by sheet from the cassette 26 in synchronism with the reciprocal movement of the rest 12 and is transferred to the transfer device 22 through the first transfer conveyor 28.

In the transfer device 22, the bias means 62 responds to the pushing of the start button to allow the DC power source to apply the DC voltage to the first roller portion 58. When the copying paper P reaches between the first roller portion 58 and the photosensitive layer 14b, the paper P may be considered as an insulating material and therefore the paper P is dielectric-polarized. The dielectric polarization of the paper P transfers the visible image on the photosensitive layer 14b onto the copying paper P.

When reached the transfer device 22, the one side portion of the copying paper P, which faces the nonvisible image layer 14c, is not in contact with the surface of the drum 14 because of the presence of the peeling member 46. The paper P further travels not contacting at the side portion with the drum surface, and enters between the second roller portion of the transfer roller 48 and the small roller 66. Then, the paper P begins to be peeled from the photosensitive drum 14 at the side portion of the paper and travels to the second transfer conveyor 36. In this case, the remaining part of the copying paper P is transferred being nipped between the first roller portion 58 and the photosensitive layer 14b.

As described above, since the first roller portion 58 is made of soft material, it tightly contacts, under the energization of the spring 52, with the photosensitive layer 14b being distorted with the distortion of x until the second roller portion 60 reaches the peeling member 46. Therefore, a contact area of the paper P with the photosensitive layer 14b increases. Further, the radius of the second roller portion 60 is smaller than that of the first roller portion 58 by the distortion amount x. Therefore, the peripheral speeds of the photosensitive drum 14, the transfer roller 48 and the small roller 66 are equal to one another.

As described above, according to the first embodiment of the present invention, the transfer process and the peeling process may be made by a single transfer device 22. Therefore, the space required for the respective processes may be remarkably reduced compared to the conventional copying apparatus. In addition, the structure of the copying apparatus may be simplified. In this respect, the transfer device can realize the size-down, light weight and cost reduction of the copying apparatus by the diameter reduction of the photosensitive drum.

Since the second roller portion 60 of the transfer roller 48 is made of insulating material, the current leakage never occurs through the small roller 66 and the separation member 46, resulting in improvement of the transfer efficiency.

Further, the transfer speed of the paper P nipped between the first roller portion 58 and the photosensitive drum 14 is equal to that of the paper P nipped between the second roller portion 60 and the small roller 66. Accordingly, there is eliminated a transfer double due to a nonuniform paper transfer speed.

The present invention is not limited to the above-mentioned embodiment but may be changed or modified variously within the scope of the present invention.

In the first embodiment, the DC power source 64 as the bias means 62 is employed for the transfer process. The DC power source for the bias means may be replaced by other suitable means, alternatively.

Figure 6:
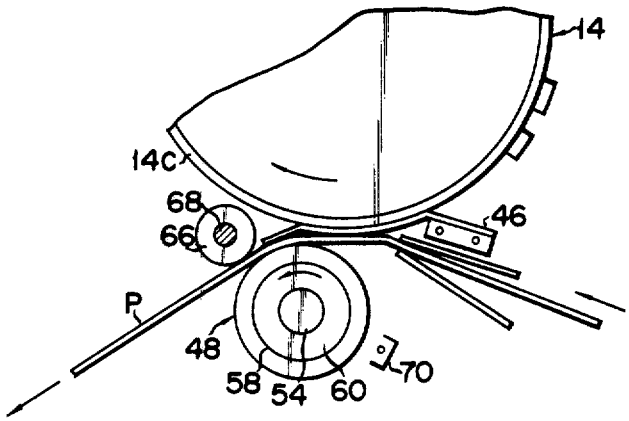
FIG. 6 is a side view of a second embodiment of a transfer device according to the invention.

Turning to FIG. 6, there is shown a second embodiment of a transfer device according to the invention. In FIG. 6, like numerals designate like or equivalent portions in the first embodiment.

In the second embodiment, the first roller portion 56 is made of insulating material with a resistivity of preferably $10^{10}$ ohm.cm or more. A corona charger 70 is disposed adjacent to the first roller 58.

With such a construction, the first roller portion 58 is charged by the corona discharger 70 to a given potential, so that the toner image on the photosensitive layer 14*b* is transferred to the paper P.

Figure 7:
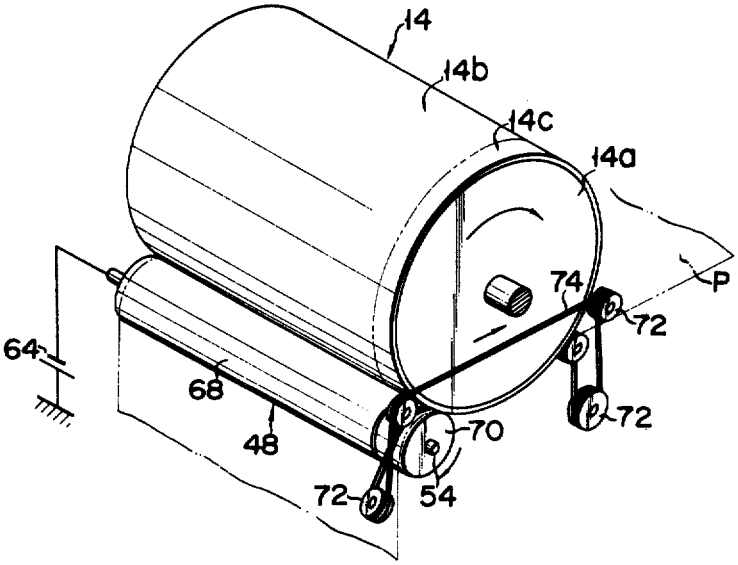
FIG. 7 is a perspective view of a third embodiment of a transfer device according to the present invention.

The first embodiment employs the small roller 66 for the peeling member, but the peeling member is not limited to the small roller and may be any means so long as it can peel the paper P from the drum 14. For example, this may be realized by a mechanism shown in FIG. 7 which is a third embodiment of a transfer device according to the present invention.

As shown, a plurality of pulleys wound by a peeling belt 74 are provided. The peeling belt 74 made of insulating material slidably contacts with the bottom of the non-visible image layer 14*c* on the photosensitive drum 14 and a part of the peripheral surface of a second roller portion 70 of a transfer roller 48. The peeling belt 74 travels at a speed equal to the peripheral speed of the photosensitive drum 14 and the transfer roller 48.

The third embodiment with such a construction can attain the almost equal effects as attained by the first embodiment. Additionally, the third embodiment does not need the peeling member 46 which was used in the first embodiment and eliminates a relative speed between the peeling belt 74 and the paper P. As a result, no excessive force is applied to the paper P, leading no improvement of the transfer efficiency of the paper P.

What is claimed is:

1. A transfer device for an electrostatic copying apparatus including a rotatable photosensitive drum having a first peripheral layer on which a toner image is formed and a second peripheral layer which is coaxially adjacent to said first peripheral layer along a rotating axis of said drum and on which a toner image is not formed, and a peeling mechanism for peeling a copying paper from said photosensitive drum, said transfer device comprising:

a transfer roller which is rotatably disposed in opposition to said photosensitive drum and cooperates with said photosensitive drum to nip the copying paper therebetween, said transfer roller including a first roller portion in opposition to said first peripheral layer of said photosensitive drum and a second roller portion coaxial with said first roller portion, and means for applying a surface electrical potential to said transfer roller to electrically attract the visible image from said photosensitive drum to the copying paper, said peeling mechanism is being disposed in opposition to said second roller portion of said transfer roller which cooperates with said second roller portion to nip one end of the copying paper to peel the copying paper from said photosensitive drum, and including a peeling member which is disposed between said second peripheral layer of said photosensitive drum and said second roller portion of said transfer roller and nips one side of the copying paper with the assistance of said second roller portion of said transfer roller, while the one side of the copying paper is not in contact with said second peripheral layer, and a peeling roller rotatably contacting on the second roller portion of the transfer roller, said peeling roller being disposed downstream from said peeling member in a direction of the rotation of said transfer roller and nips with the assistance of said second portion of said transfer roller the one side of the copying paper transferred.

2. A transfer device according to claim 1, wherein said first roller portion of said transfer roller rotatably contacts said first peripheral layer of said photosensitive drum so as to allow the nipping of the copying paper therebetween.

3. A transfer device according to claim 2, wherein said first roller portion of said transfer roller is made of conductive material and said surface electrical applying means includes a power source to apply a DC bias voltage onto a peripheral surface of said transfer roller.

4. A transfer device according to claim 2, wherein said first roller portion of said transfer roller is made of insulating material and said surface electrical potential applying means which is disposed in opposition to said transfer roller and includes a corona charger for applying corona ions onto the peripheral surface of said transfer roller.

5. A transfer device according to claim 4, wherein said peeling roller is made of insulating material.

6. A transfer device according to claim 5, wherein said second roller portion of said transfer roller is made of insulating material.

7. A transfer device according to claim 6, wherein said first roller portion of said transfer roller has a larger radius than said second roller portion.

8. A transfer device according to claim 7, wherein said first roller portion of said transfer roller is made of material softer than said second roller portion.

9. A transfer device according to claim 3 or 4, wherein said peeling mechanism includes an endless belt wound contacting at least a portion where said second peripheral layer of said photosensitive drum is in opposition to the surface of said second roller portion of said transfer roller.

10. A transfer device according to claim 9, wherein said endless belt is supported by a plurality of rotatable pulleys.

11. A transfer device according to claim 10, wherein said endless belt travels at a speed substantially equal to a transfer speed of the copying paper.

12. A transfer device according to claim 11, wherein said second portion of said transfer roller is made of insulating material.

13. A transfer device according to claim 12, wherein said first portion of said transfer roller has a larger radius than that of said second roller portion.

14. A transfer device according to claim 13, wherein said first roller portion of said transfer roller is made of material softer than said second roller portion.

* * * * *